US005170901A

United States Patent [19]

Bersani

[11] Patent Number: 5,170,901

[45] Date of Patent: Dec. 15, 1992

[54] TRANSPORTABLE CONSTRUCTION ELEMENT IN THE FORM OF A CONTAINER

[75] Inventor: Pierre Bersani, Bursinel, Switzerland

[73] Assignee: Parteurosa, Société Anonyme, Luxembourg, Luxembourg

[21] Appl. No.: 442,525

[22] Filed: Nov. 28, 1989

[30] Foreign Application Priority Data

Nov. 28, 1988 [BE] Belgium ..... 08801343

[51] Int. Cl.[5] ..... B65D 87/02

[52] U.S. Cl. ..... 220/1.5; 52/67; 220/8

[58] Field of Search ..... 220/1.5, 4.03, 8; 52/67, 69, 71

[56] References Cited

U.S. PATENT DOCUMENTS

| | | | |
|---|---|---|---|
| 1,972,415 | 9/1934 | Anderson | 296/26 |
| 2,395,691 | 2/1946 | Smith | 52/69 |
| 2,470,223 | 5/1949 | Powels | 220/8 X |
| 2,636,773 | 4/1953 | Van Tassel | 52/67 X |
| 2,850,320 | 9/1958 | Grochmal | 296/23 |
| 2,902,312 | 9/1959 | Ferrera | 296/23 |
| 3,106,750 | 10/1963 | Jarman | 52/67 X |
| 3,169,280 | 2/1965 | Jarman | 20/2 |
| 3,200,545 | 8/1965 | Bunge | 52/67 X |
| 3,966,075 | 6/1976 | Schultz | 220/8 X |
| 4,242,846 | 1/1981 | Hurd et al. | 52/71 |
| 4,711,257 | 12/1987 | Kobayashi | 52/67 X |
| 4,958,874 | 9/1990 | Hegedus | 52/67 X |

FOREIGN PATENT DOCUMENTS

| | | |
|---|---|---|
| 0127070 | 12/1984 | European Pat. Off. . |
| 2587389 | 3/1987 | France . |

*Primary Examiner*—Steven M. Pollard

*Attorney, Agent, or Firm*—Spencer, Frank & Schneider

[57] ABSTRACT

Transportable construction element in the form of a container (1), comprising at least one hinged panel (4) capable of pivoting between a closed position and an open position swung outwards, as well as an internal structure (11) open downwards, comprising an upper panel (12), a front panel (13) and at least two side panels (14) and having a rear opening opposite the said front panel. This internal structure is supported by the container so as to be movable along a path (F), between an inserted position, situated inside the container, and an extended position, in which the hinged panel of the container forms a floor for the internal structure.

21 Claims, 7 Drawing Sheets

TRANSPORTABLE CONSTRUCTION ELEMENT IN THE FORM OF A CONTAINER

BACKGROUND OF THE INVENTION

The present invention relates to a transportable construction element in the form of a container, comprising:

a bottom wall, a top wall and side walls assembled with one another, as well as corner elements arranged on the container so as to absorb external compressive or tensile forces, and at least one hinged panel capable of pivoting between a closed position in which it forms at least a part of one of the walls of the construction element, and an open position, swung outwards.

Transportable construction elements of this kind, in the form of a container, are already known and in particular those are described in LU-A-85595.

In this patent, a hinged panel forming an entire side wall of the container is provided. This hinged panel may be made to pivot outwards so that, in the swung-out position, its internal surface is coplanar with the internal surface of the floor of the container. The hinged panel is connected in a fixed manner to two of the corner elements, which are arranged at the corners of the container so as to absorb external compressive or tensile forces, in particular during transportation of the container and assembly of a structure using this container. During its pivoting movement outwards, the hinged panel moves these two corner elements with it so as to form a stable and solid structure, for example a passageway between two assembled containers. Such assembled containers may be intended, amongst other things, for the construction of a hospital, of the mobile type for example. According to this patent, together with swinging-out of the hinged panel, side curtains running along the edge of this passageway are also unfurled.

On its own, however, such a container does not allow a closed rigid structure to be constructed, which, after the extension stage, has a volume larger than that of the transported container, this volume being sheltered from the external atmosphere and hence bad weather, as well as from radiation, exploding shells, etc.

For a long time transportable containers have also been known which are provided with corner elements and at least one side panel of which may be made to pivot outwards, certain walls carrying inside the container devices, apparatus, equipment, furniture, etc., mounted in their final position before transportation (see, for example, the patents GB-1,347,177 and GB-1,603,613). Also known are transportable containers, provided with corner elements and comprising panels which can be swung outwards by means of pivoting, which enable the internal volume of the container to be extended by a canopy (see FR-A-2,476,716). In this container also, equipment and apparatus may be definitively mounted beforehand, inside the container.

These latter containers have, in the extended position, a plane of the inner face of the swung-out panel which is offset relative to the plane of the internal surface of the ceiling or floor relative to which it pivots. In the extended position, these containers either are completely open outwards or have a canopy open outwards. They are therefore not designed to form, in the extended state, a closed construction totally sheltered from bad weather conditions.

Transportable containers are also known which allow enlargement of the volume of the container when the latter is installed, namely through the swinging out—which is often a complex operation—of pivoting panels (see EP-A-0,077,103 and WO-84/00573). These containers, however, are not to easy to handle during transportation because they have no corner elements facilitating the manoeuvres necessary, for example, for suspension from lifting appliances and fixing on transportation vehicles. Their arrangement is such that the mounting of heavy equipment on the internal walls of the container is not possible or is possible in very few cases.

Also known is an expandable, transportable camping structure, which, after setting up, has the shape of a house with a sloping roof and gables (see U.S. Pat. No. 3,653,165). In order to set up the house, in addition to several operations involving pivoting of various panels, there is a first stage consisting in sliding a movable section of the structure relative to a fixed section. Like the fixed section, the movable section is supported by jacks or jackscrews, this being complicated during sliding of the movable section, or it is supported in cantilever fashion by the fixed section, in particular by means of telescopic beams. During transportation, no equipment may be provided inside the movable section and few objects may actually be fixed inside the fixed section. The structure in question is a light structure, which is complex as regards construction and assembly and which has no corner elements. When folded away, the structure does not constitute a single container, but it always forms an assembly consisting of two sections fitted one inside the other in a manner visible from the exterior.

In addition to being difficult to handle during transportation, this arrangement requires operation of the slide, formed by the movable section, during transportation. Frequent opening and closing with successive changes in position of this structure would rapidly damage the latter.

Expandable structures are known, external sections of which may slide outwards relative to a central section (WO-84/01974) and which have the same drawbacks with regard to handling and fitting together as the preceding structure.

As is described in the introduction of U.S. Pat. No. 3,653,165, camping trailers are also already known which can assume a compact form for travelling purposes and an extended form by means of a tent.

SUMMARY OF THE INVENTION

The object of the present invention is to provide a transportable construction element in the form of a container of the type described in the preamble, which enables the internal volume of the construction element to be extended in a simple and very robust manner, the interior of the structure in the extended position remaining quite airtight and watertight and being sheltered from bad weather over its entire enlarged volume. Advantageously, this container must allow heavy apparatus and equipment to be fixed beforehand on a large number of surfaces. The conversion of the construction element from its transportation state, where it has a small volume, into its operational state, where it has an enlarged volume, must preferably be rapid. Finally, the construction element must advantageously be very strong both in the transportation position, so as to be able to withstand the considerable stresses of transportation, lifting or other handling operations, and in the extended position where the extended part must also be "rigid". The extended structure must make thermal insulation possible and advantageously withstand radiation, exploding shells, etc. Frequent conversion from the extended state into the retracted state must not pose any problem.

The problem according to the invention is solved by a construction element, such as that described at the beginning, which comprises moreover at least one internal structure open downwards, comprising an upper panel, a front panel connected to the latter and situated opposite an aforementioned hinged panel in the closed position of the latter, and at least two side panels connected to the upper panel and to the front panel, the structure having moreover also a rear opening opposite the front panel, this structure being supported by the container so as to be movable along a path, between an inserted position, situated inside the container, and an extended position, in which the hinged panel situated opposite the front panel forms, in the open position, at least partially a floor for the internal structure.

According to a preferred embodiment, in the open position, this hinged panel has a surface coplanar with the internal surface of the bottom wall.

According to an embodiment of the invention, the construction element comprises rolling means allowing displacement of the internal structure(s) along their path. These rolling means may be rollers rotating freely about horizontal axes supported by side panels, arranged parallel to one another, of the movable internal structure, these rollers being arranged so as to be able to roll on the said bottom wall and the said hinged panel in the open position. The rolling means may also comprise at least two parallel rolling tracks provided in alignment on the said bottom wall and the said hinged panel in the open position, side panels of the internal structure being arranged so as to be able to roll on these tracks.

According to an advantageous embodiment of the invention, the construction element comprises first means for guiding the internal structure which are arranged inside the container and second guiding means which are carried by the hinged panel, these first and second guiding means being arranged relative to each other so as to prevent, during displacement of the internal structure, lateral deviation of the latter relative to the said path.

According to a preferred embodiment of the invention, the construction element comprises moreover means for immobilizing the internal structure(s) movable inside the container when the hinged panel(s) is/are in the closed position.

According to another advantageous embodiment of the invention, the internal structure(s) and/or the container has/have sealing means which insulate the interior from the exterior in the extended position of the internal structures.

Other details and features of the invention will emerge from the description given below by way of a non-limiting example and with reference to the attached drawings.

DESCRIPTION OF THE PREFERRED EMBODIMENTS

In the various drawings, identical or similar elements are indicated by the same references.

Figure 1:
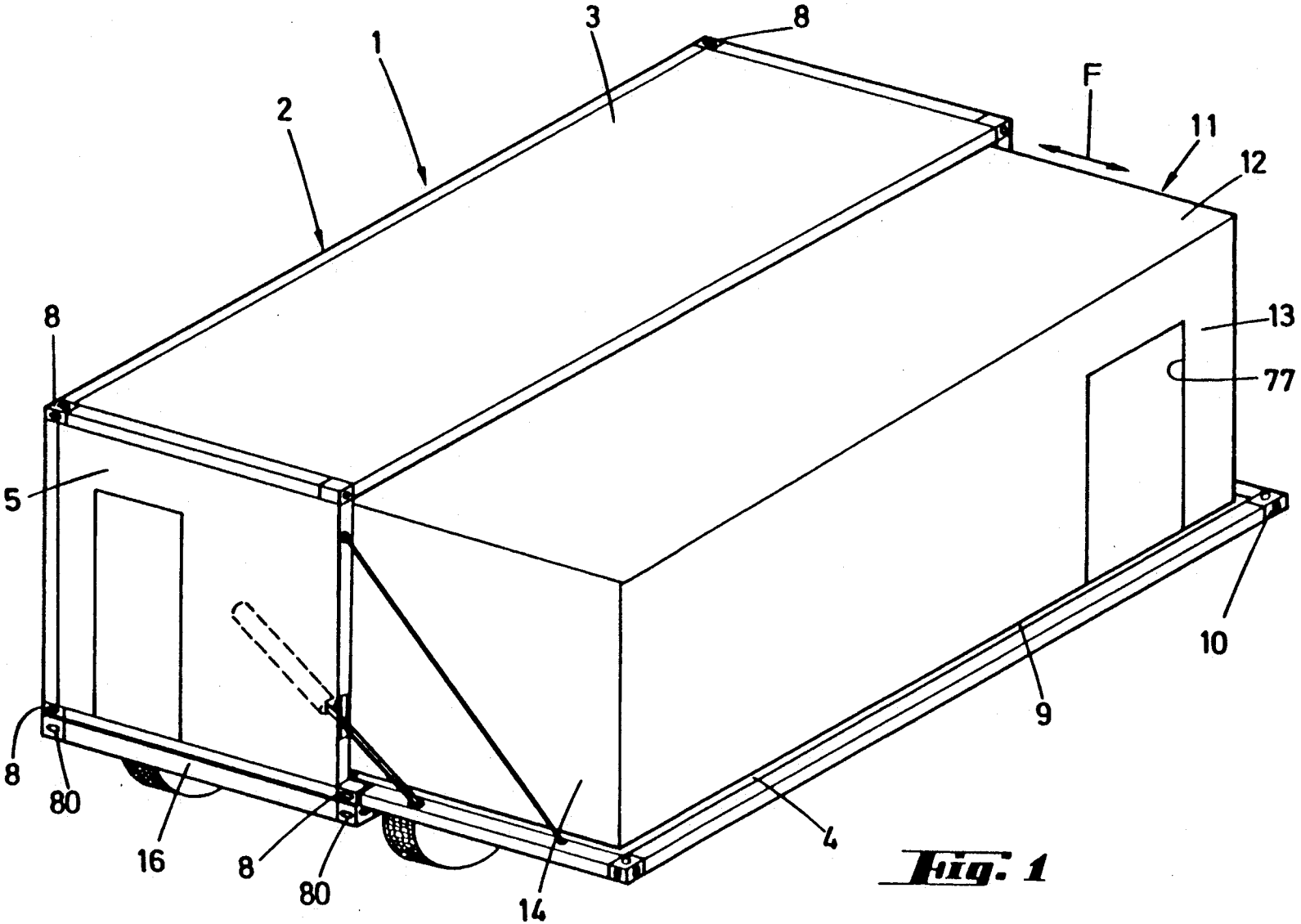
FIG. 1 shows a perspective view of an embodiment of the invention in the extended position.

FIG. 1 shows an embodiment of the construction element according to the invention in the extended position. The transportable construction element, denoted generally by the reference 1, comprises a frame 2 enclosing a bottom wall (not visible in FIG. 1), a top wall 3 and four side walls 4 to 7. These walls, in the closed condition of the construction element 1, are arranged in the example illustrated so as to form a parallelepipedal container or external structure. The frame 2 supports corner elements 8 which allow the container to absorb external compressive and tensile forces, for example for the attachment of crane hooks, for fixing on transportation vehicles designed to accommodate the containers and, if necessary, for stacking of the latter. In the examples illustrated, provision is made for standard corner elements satisfying the ISO (International Standards Organization) international transportation and handling standards (for example ISO 1161), but it is obvious that non-standard corner elements may also be provided according to the invention (see, re corner elements, for example L.A. HARLANDER, Container System Design Developments over Two Decades, Marine Technology, Vol. 19. No. 4, October 1982, pp 364–376, or also for example the patents U.S. Pat. Nos. 2,963,310, 3,691,595, 4,049,149 and 4,212,251).

As can be seen from FIG. 1, a multipurpose panel formed by all of the side wall 4 is hinged on the frame 1 so as to be able to pivot outwards. In the closed position, this multipurpose panel forms the side wall 4 of the construction element in the form of a container. In the open position, its internal surface 9 is coplanar with the internal surface of the bottom wall. This panel is connected to two of the corner elements 10 of the container, which therefore pivot together with the said panel. This hinged panel is therefore of the same type as that described in the patent LU-A-85595 and its method of hinging as well as its operating means are therefore known and will not be described in greater detail here.

It is obvious that the hinged panel or panels of the construction element according to the invention need not necessarily conform to this latter patent, as will emerge moreover from the examples of embodiment illustrated in the other figures. The bottom of the container and the internal surface of the hinged panel may advantageously form a continuous surface directly themselves or by means of an insertion element covering the joint (see, on the subject, LU-A-85595).

As can be seen from FIG. 1, an internal structure, denoted generally by the reference 11 has been pushed or pulled out of the container so as to rest on the hinged multipurpose panel 4 in the open position.

This internal structure 11 comprises an upper panel 12, a front panel 13, which is connected to the upper panel 12 and is arranged opposite the internal surface 9 of the hinged panel 4 when the latter is in the closed position, and at least two side panels 14 and 15 (only the panel 14 of which can be seen in FIG. 1). These side panels are themselves also connected to the upper panel 12, and each of them is connected to the front panel 13. This structure is open downwards; i.e., in the position in which the internal structure is fully inserted inside the container, the bottom wall of the container serves as a floor for the internal structure 11, while, in the extended position, it is the hinged panel 4 which performs this function, at least partially.

Opposite the front panel 13, the internal structure has a rear opening which is preferably complete within the side panels 14 and 15. It may however also be only partial, with a partition (not shown) in the space which is not open. It is even possible to envisage a rear opening reduced to a door opening.

It is easy to envisage the front panel 13 and/or the side panels 14 and 15 being arranged in a totally or partially open manner. FIG. 1 shows a partial opening 77, which can be easily closed in a known manner by a door leaf.

The internal structure 11 is supported by the container so as to be movable along one path, indicated by the double arrow F, and in both directions. It may be displaced between an inserted position not shown, situated inside the container, and an extended position in which the hinged multipurpose panel 4 in the open position forms at least partially a floor for the internal structure. When the rear opening is complete, it is preferable that the internal structure 11 should not be totally extracted from the container and, in this case, a part of its floor is simultaneously formed by the bottom wall of the container.

The construction element 1 illustrated in FIGS. 2 to 8 differs from that described above in that it has a hinged multipurpose panel 17 which, here, does not form all of the side wall 4 of the container. In fact, a part 34 of the side wall 4 remains fixed in the frame 2. Moreover, the internal structure 11 in the extended position covers only a part of the hinged panel 17. The container has here a second folding panel in the form of the side wall 7. Inside the container subdivisions have been provided, for example an entrance hall 18, separated from the central chamber 19 by a partition 20 and comprising wall compartments 20 and 21, as well as an opening 22, closed by a door not shown, and providing access to a gangway formed by the side wall 7 in the swung-out position. Similarly, opposite this entrance hall 18, a compartment or an installation 23 is provided against the side wall 5 of the container. In this same way it is possible moreover to make provision for the height of the removable internal structure 11 to be much less than the free height of the chamber 19, thereby enabling a lighting system, for example, to be mounted in position beforehand.

In the example illustrated in FIGS. 2 to 8, the construction element comprises means for displacing the structure along the path F, in the form of rolling means. Here, these rolling means are rollers 24 (see FIG. 3) rotating freely about horizontal axes 25 supported by stirrups 26 fixed beneath the parallel side panels 14 and 15 of the internal structure 11. In order to be able to roll on the bottom wall 27, provision is made for example for two parallel, metal, angle irons 28, one flange 29 of which is embedded in the bottom wall 27, flush with the latter, and the other one 30 of which projects vertically upwards, along the cabinet 23. In order to be able to roll on the internal surface 9 of the hinged panel 17, provision is made for example for two parallel metal angle irons 31 (see FIG. 4), one flange 32 of which is embedded in the hinged panel 13, flush with its internal surface 9 and the other one 33 of which projects vertically upwards, in the open position of the panel.

Figure 2:
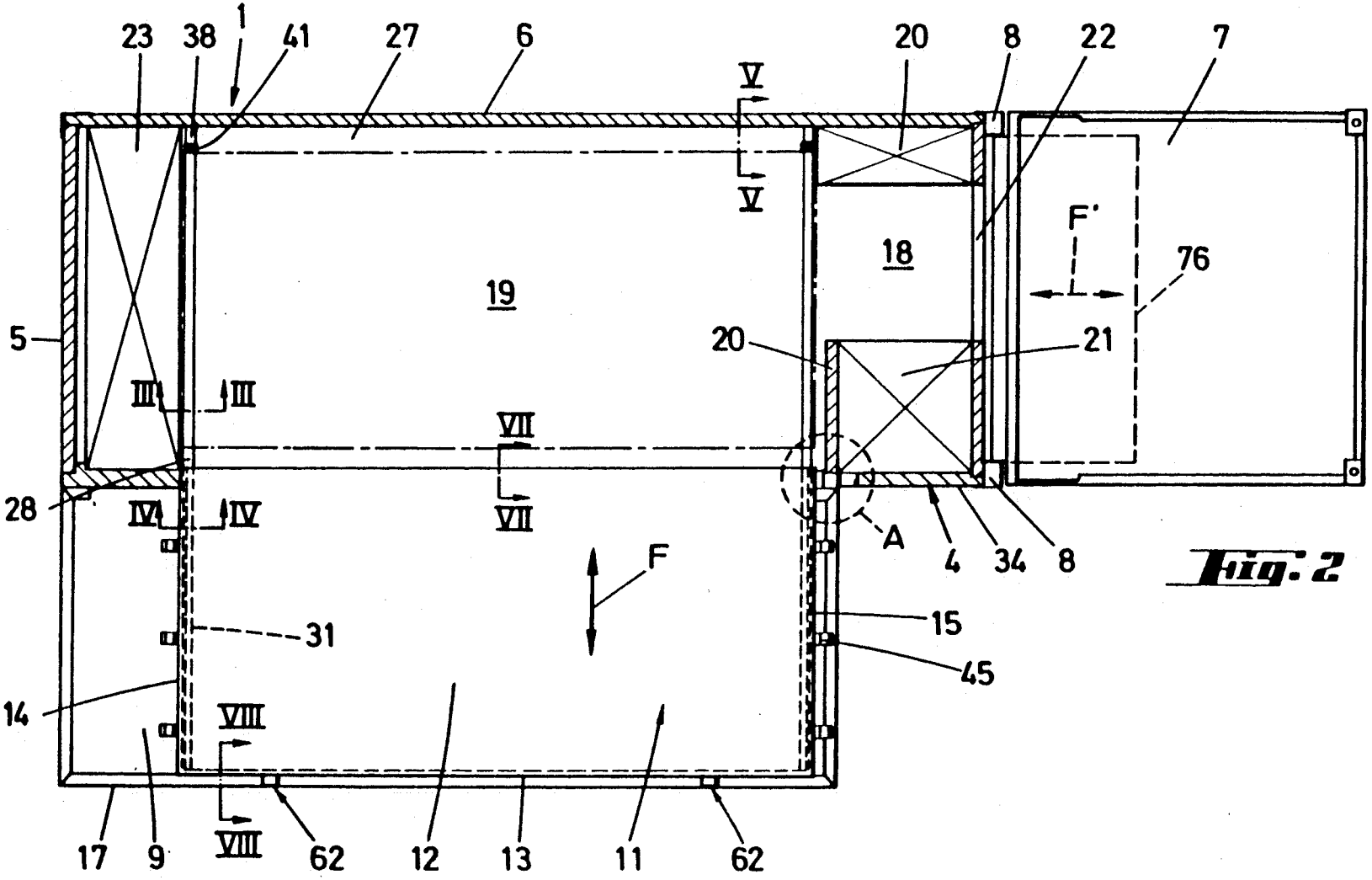
FIG. 2 shows a horizontal section through another embodiment of the invention.

As can be seen in particular in FIG. 2, the embedded flange 29 of each angle iron 28 is in alignment with the embedded flange 32 of an angle iron 31 when the hinged panel 17 is in the open position. The embedded flanges thus form two parallel rails on which the rollers 24 are able to roll.

Figure 3:
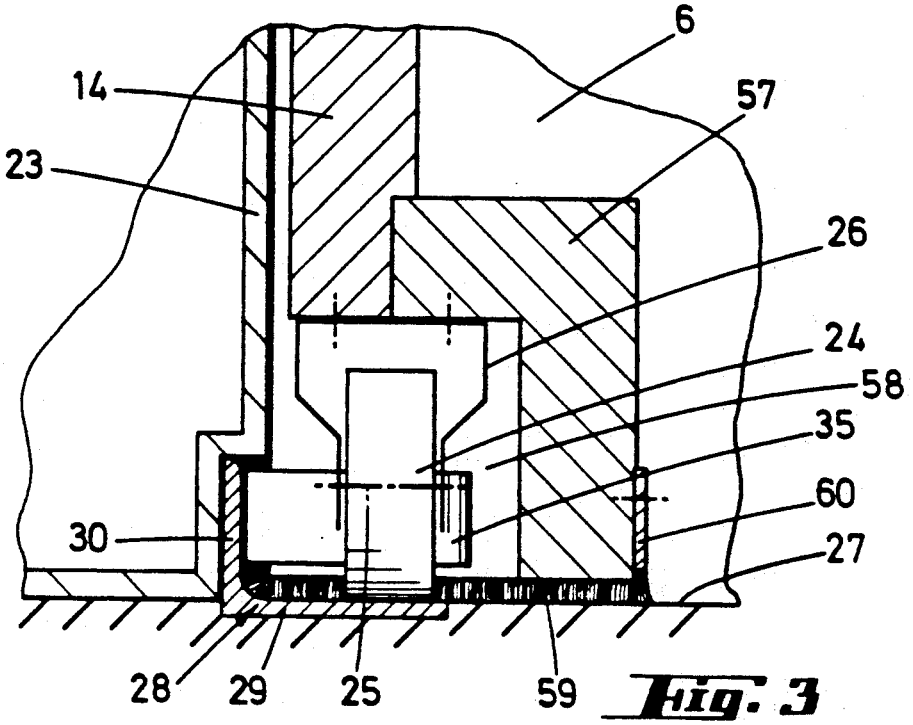
FIG. 3 shows, on an enlarged scale, a sectional partially cut-away view along the line III—III of FIG. 2.
Figure 4:
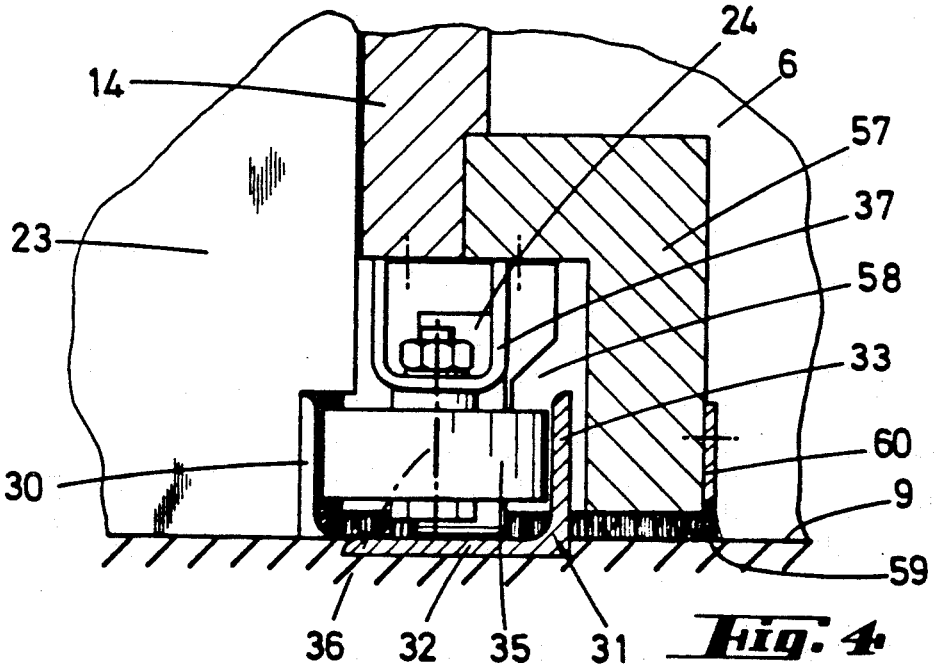
FIG. 4 shows, on an enlarged scale, a sectional partially cut-away view along the line IV—IV of FIG. 2.

As can be seen in particular in FIGS. 3 and 4, the abovementioned rails, formed by the angle irons 28 and the angle irons 31, form guiding means for additional rollers 35 also carried by the side panels 14 and 15 of the internal structure. These additional rollers 35 rotate freely about vertical axes 36 supported by stirrups fixed beneath the side panels 14 and 15. These rollers cooperate, inside the container, with the vertical flanges 30 of the angle irons 28 and, on the hinged panel 17, with the vertical flanges 33 of the angle irons 31. The angle irons prevent, during displacement of the internal structure 11, lateral deviation of the latter relative to the path F.

Figure 5:
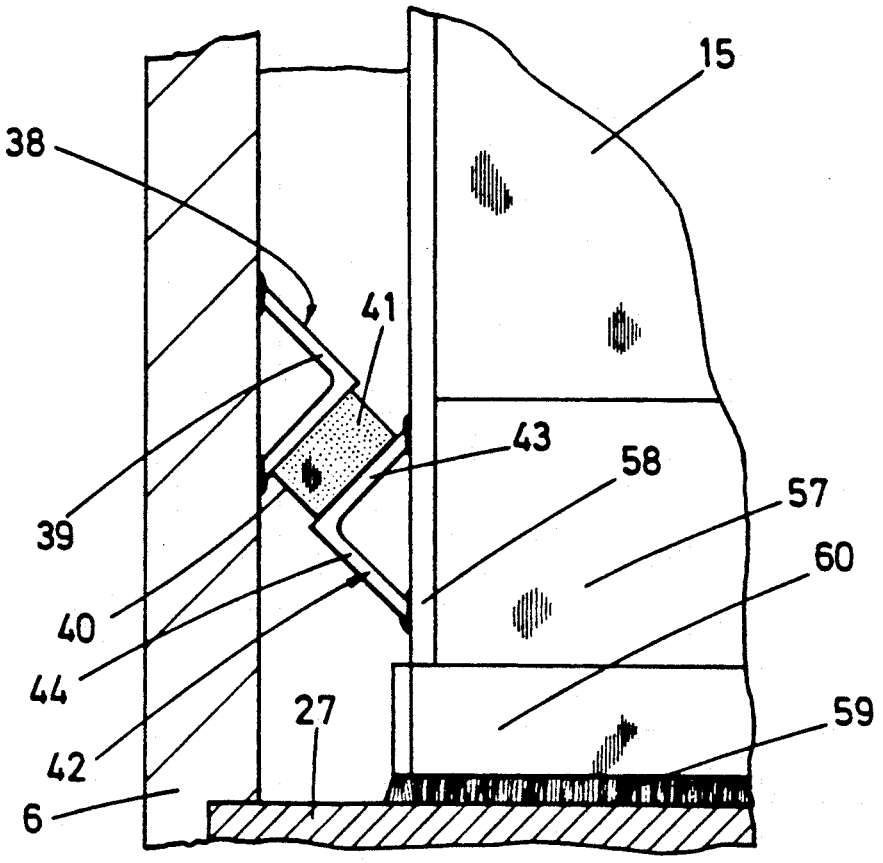
FIG. 5 shows, on an enlarged scale, a sectional partially cut-away view along the line V—V of FIG. 2.
Figure 6:
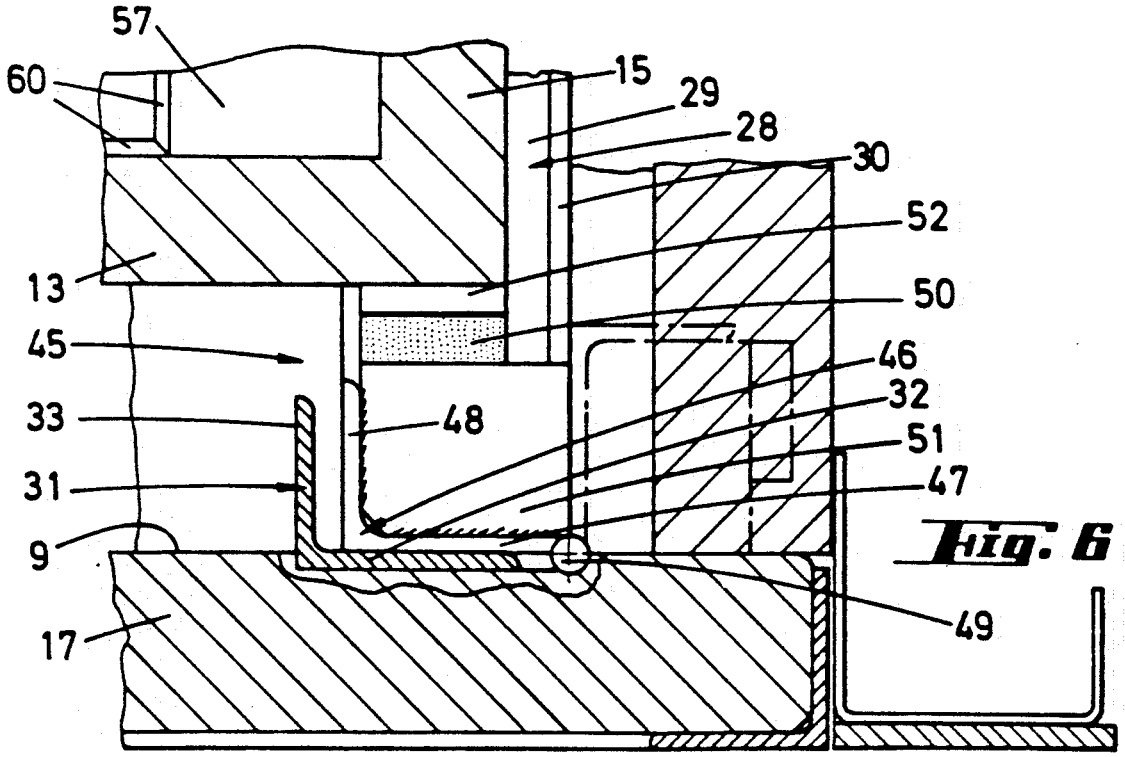
FIG. 6 shows, on an enlarged scale, a horizontal section of the detail A according to FIG. 2, in the closed position of the container.

As can be seen in FIGS. 2, 5 and 6, the construction element 1 comprises moreover means for immobilizing the removable internal structure inside the container when the hinged panel 17 is in the closed position. The fully inserted position of the internal structure 11 is shown in dot-dash lines in FIG. 2.

In the example illustrated here, in particular in FIG. 5, these immobilizing means comprise stop elements 38 in the form of angle-iron sections, of which the two ends of the mutually perpendicular flanges 39 and 40 are fixed on the inner face of the side wall 6 of the container. These stop elements are arranged opposite the rear vertical edges of the panels 14 and 15 of the internal structure 11, such that the external surface of the flanges 40 is arranged in a plane oblique relative to the path F. Here the external surface of the flanges 40 forms a plane inclined at 45° relative to this direction. This surface carries a parallelepipedal block 41 made of elastic material, whose surface situated opposite the angle iron 38 is also arranged in a plane inclined at 45° relative to the path F.

Counter-stop elements 42, in the form of angle-iron sections, are provided on each of the rear vertical edges of the panels 14 and 15. The two ends of the flanges 43 and 44 of the angle irons are fixed to these edges such that the external surface of the flanges 43 is arranged in a plane at an angle, here of 45°, relative to the path F. When the internal structure 11 is in the fully inserted position, the external surface of each flange 43 comes into contact with the external surface of a block 41.

In this arrangement, when the internal structure 11 is somewhat slightly pressed towards the rear wall 6, the immobilizing means described above prevent any displacement of the internal structure 11 relative to the container, not only towards the rear; i.e., towards the wall 6, but also upwards. It is clearly understood that other immobilizing means could be provided, and in particular separate means for immobilizing the internal structure vis-à-vis a backward or upward movement.

In the embodiment illustrated, the vertical flanges 30 of the angle irons 28 and the rollers 35 serve as means for immobilizing the internal structure 11 so as to prevent lateral displacement of the latter relative to the said path F, in the closed position of the hinged panel 17.

Finally, the abovementioned immobilizing means also comprise, in the example illustrated in particular in FIG. 6, clamping elements 45 which, in the closed position of the hinged panel 17, are arranged between the internal surface 9 of the hinged panel 17 and the front panel 13 of the internal structure 11. These clamping elements 45 are provided to prevent any forward displacement of the internal structure 11, in the closed position of the hinged panel 17.

In the example illustrated, the clamping elements 45 consist of several angle-iron sections 46, one of the flanges 47 of which is supported on the hinged panel so as to be able to pivot about an axis 49 parallel to the path F. The other flange 48 extends perpendicularly relative to the internal surface 9 of the hinged panel 17, when the flange 47 is applied against the hinged panel 17, in its clamping position. A buffer made of elastic material 50 is supported by the angle-iron section 46, via a metal block 51 welded between the two flanges 48 and 49. In the closed position of the hinged panel 17, the buffer 50 of each angle-iron section 46 bears against the front panel 13, where applicable, as illustrated, via a metal plate 52 supported by the front panel 13. The stop and counter-stop elements 38, 41 and 43 described previously and the clamping elements 45 described above are arranged so that closure of the hinged panel allows the internal structure to be pressed between these elements, in particular owing to the parts of the latter made of elastic material.

With the aid of the immobilizing means described above, the internal structure 11 is firmly anchored inside the container during transport. The internal structure 11 is not subject to any stress during handling and transportation of the construction element.

As is shown in FIG. 6 in broken lines and in FIG. 2 in solid lines, when the hinged panel 17 is in the open position, the clamping elements 45 are brought into a retracted position which frees the passage for the internal structure 11 and which is therefore located outside the latter in its extended position.

The construction element according to the invention must be able to serve as a structure which can be inhabited and heated. Provision is therefore made for sealing means which insulate the interior from the exterior, in the extended position of the internal structure 11. Various means known per se may be used for this purpose.

Figure 7:
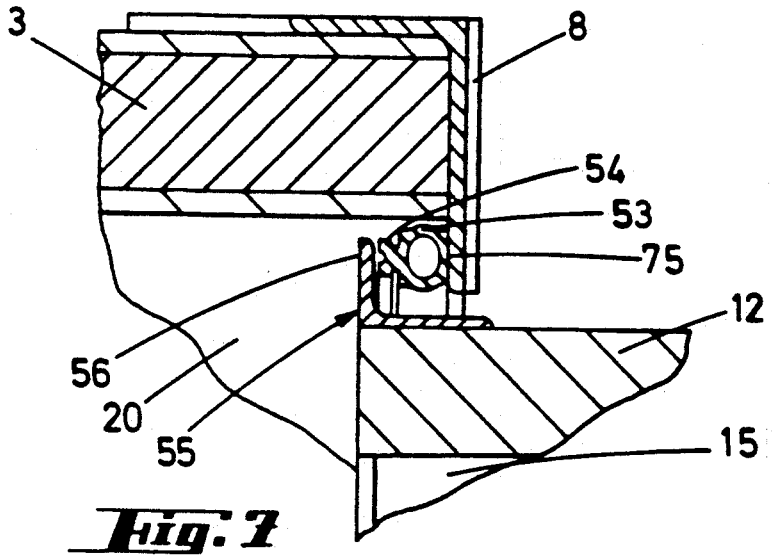
FIG. 7 shows, on an enlarged scale, a vertical section, partially cut-away, along the line VII—VII of FIG. 2.

FIG. 7 shows a sealing means of this kind. It consists of a tube made of elastic material 53 provided with sealing lips and supported by a raised edge 75 projecting towards the bottom of the top wall 3. The upper panel 12 of the internal structure 11 supports along its rear edge an angle iron 55, one flange 56 of which, projecting upwards, presses against the sealing lips 54 in the extended position of the internal structure 11. It is obviously possible to provide a corresponding arrangement along the rear edges of the side panels 14 and 15 of the internal structure.

Figure 8:
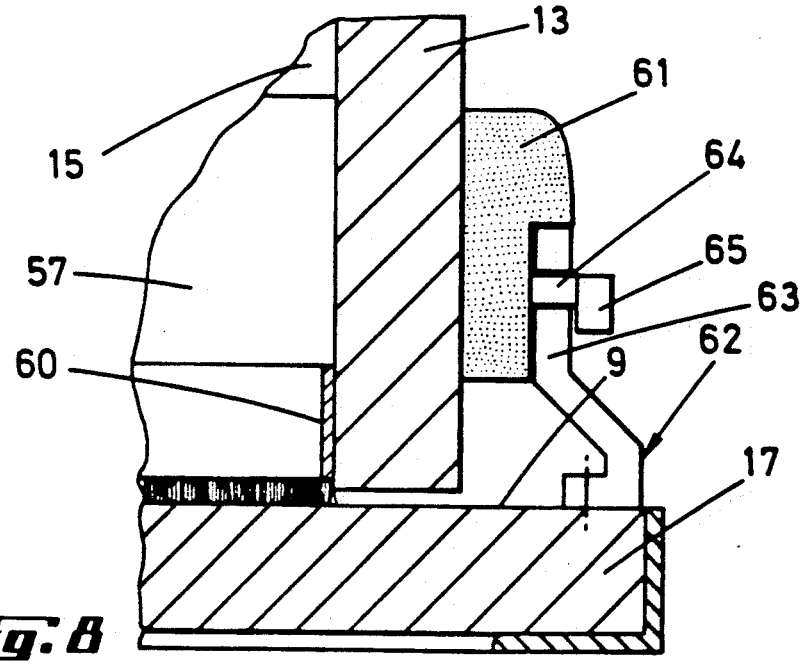
FIG. 8 shows, on an enlarged scale, a partially cut-away sectional view along the line VIII—VIII of FIG. 2.

As can be seen in particular in FIGS. 3 to 5, the rollers supported by the panels 14 and 15 are separated from the internal volume of the structure 11 by a partition 57, in the shape of an L in cross-section, which runs along the bottom edge of each of these panels, as well as by an end plate 58. The spaces between the partitions 57 and the end plates 58, on the one hand, and the bottom wall 27 or the internal surface 9 of the hinged panel 17, as well as the vertical flange 30 of the angle irons 28, on the other hand, are sealed by means of a sealing element 59. The latter is supported on the partitions 57 or the end plates 58 by means of support plates 60 so as to rub flexibly against the surface situated opposite during displacement of the internal structure. As can be seen in FIG. 8, a similar arrangement may be provided along the front panel 13 of the internal structure 11.

It would, of course, be possible to provide other types of sealing elements in place of those described here or together with them. One could envisage, for example, removable elements which would leave the internal structure free, during displacement thereof, and which could be locked in the sealing position when the internal structure is in the extended position.

As can be seen in FIG. 8, it is possible to provide, in accordance with the invention, means for locking the internal structure in the extended position on the hinged panel 17. The front panel 13 of the internal structure supports one or more bearing plates 61 against which metal profiled sections 62, fixed on the internal wall 9 of the hinged panel 17, come to rest. A flange 63 of each of these profiled sections 62 is arranged so as to cooperate with the external surface of a bearing plate 61, in the extended position of the internal structure 11. In this way, the profiled sections form part of the means which limit the travel outwards of the internal structure 11.

A shaft 64 may be provided, projecting forwards, on each bearing plate 61. This shaft is supported so as to be able to pivot about its axis and its free end has a bolt element 65 in the form of a projection perpendicular to the pivoting axis of the shaft 64. The profiled sections 62 have in their flange 63 a lateral notch, open on one side, through which the shaft 64 and the bolt element 65 are able to pass horizontally. When the flange 63 is in contact with the bearing plate 61, the bolt element 65 may be made to pivot downwards into the position shown in FIG. 8 and it thus prevents any backward movement of the internal structure 11.

It is obvious that other locking means may be provided, in particular with automatic closure, and that they may be provided not only on the hinged panel, but also on any other fixed part of the container.

Figure 9A:
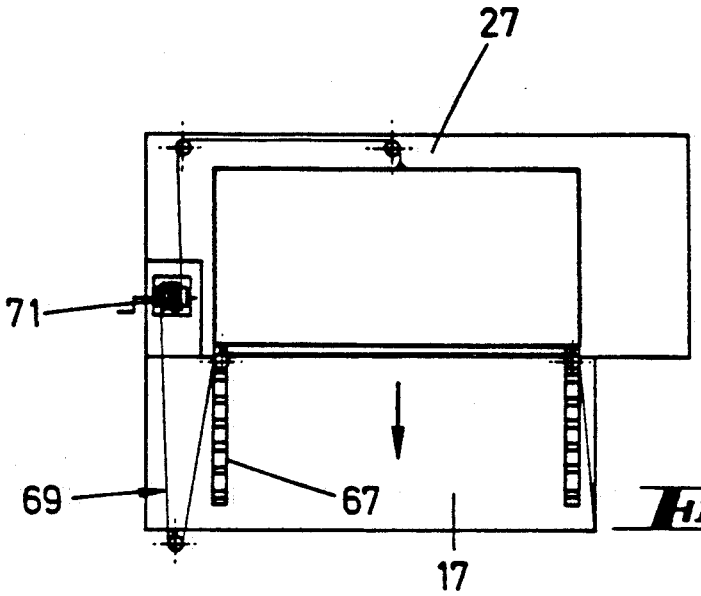
FIGS. 9*a* and 9*b* show a schematic plan view of yet another embodiment of the invention in two different positions.
Figure 9B:
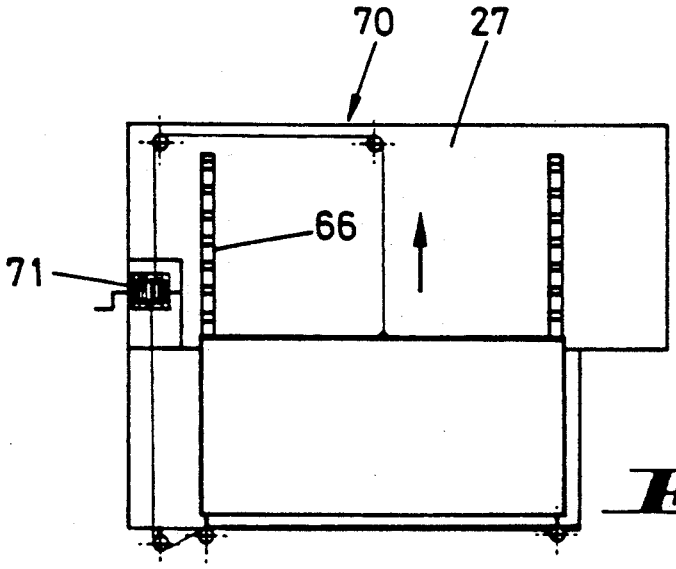

FIGS. 9*a* and 9*b* show in schematic form another embodiment of the invention. In the figures, the part of the container above the floor has been eliminated so as to facilitate comprehension.

The construction element illustrated differs from that described above in that the rolling means provided here are two rolling tracks 66 parallel to the path F and provided in the bottom wall 27 such that they lie flush with or project slightly relative to the internal surface of the latter. Aligned with them, provision is made for two rolling tracks 67 provided in the hinged panel 17 such they lie flush with or project slightly relative to the surface 9 of the panel. The bottom edges of the side panels 14 and 15 of the internal structure 11 are arranged so as to be able to slide on the rolling tracks 66 and 67.

In this example of embodiment, it is possible to envisage the internal surface of the bottom wall and that of the hinged panel not being exactly coplanar. It is sufficient for the rolling tracks and in particular the tops of the latter to allow the internal structure to travel on them.

In the example of embodiment according to FIGS. 2 to 8, provision has been made for panels with an internal structure made of a resistant, but fairly light material, for example with a honeycombed texture, so as to allow any manual displacement of the internal structure. It is possible, for example, to envisage, pushing the latter from the inside after entering the container via a door provided for this purpose. However, these panels must be self-supporting and advantageously be able to support equipment mounted beforehand on their inner face.

It is also possible to provide means for driving the internal structure which are of a mechanical, hydraulic, electrical or other nature, with or without the use of a motor. An example of such a system is illustrated in FIGS. 9*a* to 9*b*. Drive means 69 and 70, in the form of cables guided by pulley systems, move the internal structure along the path F, both ways, depending on the operation, in this case, of the winch 71.

As can be seen in FIG. 1, the frame 2 of a container according to the invention may be supported in a known manner on a platform 16 of a transportation vehicle, which is provided with fixing elements 80, known per se, onto which the lower corner elements 2 may be fastened (see for example GB-1,603,613).

If the transportable construction element 1 is envisaged for the formation, for example, of a mobile hospital unit, the latter can be set up extremely rapidly. After the vehicle has stopped, the side wall 4 or the hinged wall 17 is swung outwards in a known manner, then the internal structure is displaced into its extended position and clamped in this position. The apparatus is already mounted in place on the four panels of the internal structure as well as on the rear wall and the floor of the container.

Stabilization of such a container is immediate since the vehicle provides an adequate counterweight to the internal structure supported in cantilever fashion by the side panel. It is also possible to envisage, by way of addition, the use of stabilizers, which are hydraulic for example, known for use in stabilizing trailer or lorry chassis.

It is possible to envisage setting up a hospital unit so that it is ready for operation in about 10 to 15 minutes. The setting-up of a complete hospital comprising several units of this kind, assembled and communicating with each other, takes approximately one hour or less. This represents a great improvement compared to the 6 hours generally required to set up a hospital in tent form.

Moreover, compared to the structures obtained as a result of erecting a tent, the structure according to the invention offers the great advantage of a solid structure on which apparatus may be already mounted beforehand and which offers better protection from external phenomena, such as exploding shells, radiation, rain, hail, etc., as well as very good thermal insulation.

It must be understood that the present invention is in no way limited to the embodiments described above and that many modifications may be made to it without departing from the scope of the present patent.

It is possible, for example, to envisage several displaceable internal structures. In the example of embodiment illustrated in FIG. 2, it is possible to envisage according to the invention an additional removable structure 76 which, in the extended position, would be in the position shown in broken lines on the opened out wall 7. This structure 76 is displaced along the path F'.

Figure 10:
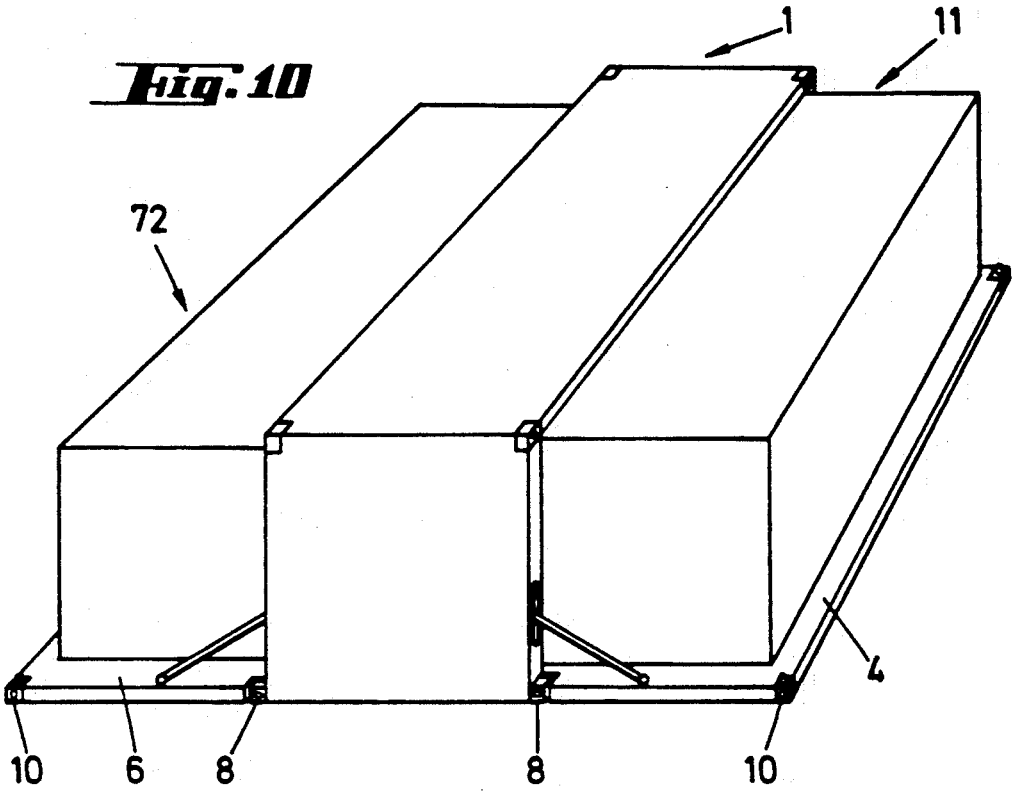
FIG. 10 shows a schematic perspective view of yet another embodiment of the invention.
Figure 11:
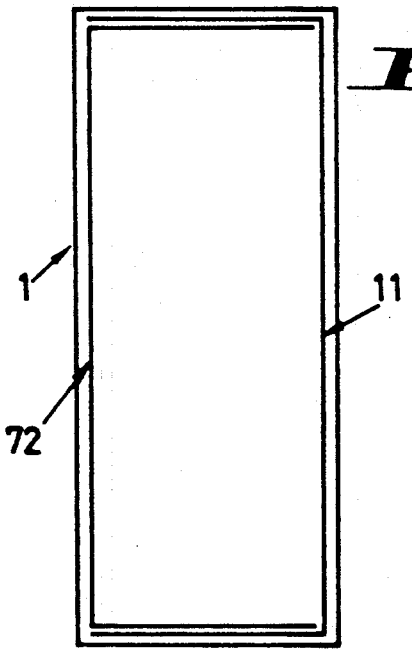
FIG. 11 shows a schematic plan view of the construction element according to FIG. 10 after the internal elements have been fully inserted.
Figure 12:
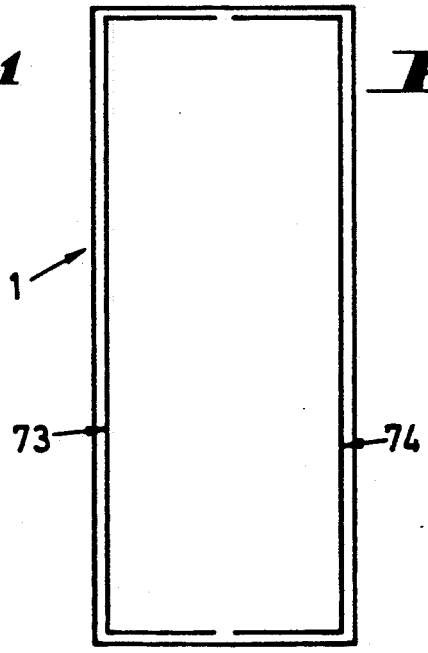
FIG. 12 shows a view similar to FIG. 11 of yet another embodiment of the invention.

It is also possible to envisage construction elements such as those illustrated in FIGS. 10 to 12. In FIGS. 11 and 12, the part of the container above the floor has been eliminated to facilitate comprehension.

According to the embodiment illustrated in FIG. 10, the transportable construction element 1 does not comprise any supporting or enclosing frame. The top, bottom and side walls are self-supporting. The construction element comprises here two hinged panels formed by two opposite side walls 4 and 6, which are of the type described in LU-A-85595.

A removable internal structure 11, corresponding to that described for the example of embodiment illustrated in FIG. 1, is arranged so as to rest, in the extended position, on the wall 4 set in the open position. A second removable internal structure 72 is arranged so as to rest, in the extended position, on the further multipurpose panel or wall 6 set in the open position.

As can be seen in FIG. 11, the internal structure 72 is smaller than the internal structure 11 so as to be able to slide inside the latter, when the structure 72 is fully inserted inside the construction element. It is possible, moreover, to imagine, instead of such structures 11 and 72, internal structures 73 and 74 not sliding one inside the other in their fully inserted position, as is shown in schematic form in FIG. 12.

The general shape of the container does not have to be necessarily a parallelepiped. There exist, for example, containers with a raised top for transportation in adapted cargo planes. The invention is still perfectly applicable in this case. Similarly, the overall appearance of the internal structure also does not have to be necessarily a parallelepiped, for the same reasons.

What is claimed is:

1. A transportable construction element in the form of a container, comprising:

an external structure including a bottom wall, a top wall, and a plurality of side walls disposed between and attached to said bottom and top walls for defining a plurality of corners and an interior;

a multipurpose panel being hingedly attached to said external structure for movement between a first closed position in which said multipurpose panel forms a part of a front side wall of said plurality of side walls and a second open position in which said multipurpose panel serves as a floor for an internal structure;

a corner element disposed on each one of said plurality of corners for absorbing external compressive or tensile forces; and an internal structure having downwardly and rearwardly open portions and including an upper panel, two side panels, and a front panel attached to said upper and side panels; said internal structure being movably supported by said external structure for movement between a first inserted position in which said internal structure is disposed within said interior of said external structure and said front panel is adjacent said multipurpose panel in its first closed position and a second extended position in which said internal structure is disposed substantially outwardly of said interior of said external structure and said downwardly open portion is adjacent to said multipurpose panel in its second open position serving as a floor for said internal structure.

2. A construction element according to claim 1, wherein said multipurpose panel has a surface substantially coplanar with the internal surface of said bottom wall of said external structure when said multipurpose panel is in its second open position.

3. A construction element according to claim 1, further comprising rolling means for allowing displacement of said internal structure between its first inserted and second extended positions.

4. A construction element according to claim 3, wherein said rolling means comprise rollers freely rotatable about horizontal axes supported by said two side panels, said rollers being arranged parallel to one another are arranged so as to roll on said bottom wall and said multipurpose panel in it second open position.

5. A construction element according to claim 3, wherein said rolling means comprises two parallel rolling tracks provided so as to be in alignment on said bottom wall and on said multipurpose panel in its open second position, and said two side panels of said internal structure are arranged so as to roll on said rolling tracks.

6. A construction element according to claim 1, further comprising first guiding means disposed in said interior of said external structure for guiding said internal structure; second guiding means disposed on said multipurpose panel for guiding said internal structure; said first and second guiding means being arranged relative to each other so as to prevent lateral deviation of said internal structure when said internal structure moves between its first inserted position and its second extended position.

7. A construction element according to claim 6, wherein said first and second guiding means comprise parallel rails supported respectively on said bottom wall and on said multipurpose panel; said parallel rails having at least one flange which extends vertically when said internal structure is in its second extended position; and said internal structure includes rollers which rotate about vertical axes supported by said two side panels and which cooperate with said at least one flange during displacement of said internal structure between its first inserted and second extended positions.

8. A construction element according to claim 6, wherein said first guiding means includes means for immobilizing said internal structure and for preventing lateral displacement of said internal structure when said multipurpose panel is in its first closed position.

9. A construction element according to claim 1, further comprising means for immobilizing said internal structure inside said external structure when said multipurpose panel in said first closed position.

10. A construction element according to claim 9, wherein said immobilizing means comprises stop elements supported on an internal surface of one of said plurality of side walls of said external structure; and corresponding counter-stop elements are arranged on said internal structure so as to cooperate with said stop elements when said multipurpose panel is in its first closed position.

11. A construction element according to claim 9, wherein said immobilizing means comprises clamping elements which are arranged in a clamped position between an internal surface of said multipurpose panel and said front panel of said internal structure when said multipurpose panel is in its first closed position so as to prevent said internal structure from moving from its first inserted to second extended positions.

12. A construction element according to claim 10, wherein each said stop element and each said corresponding counter-stop element has a mutual contact surface arranged in a plane extending obliquely relative to the direction of movement of said internal structure between its first inserted and second extended positions so as to prevent said internal structure from moving rearwardly and from moving upwardly when moving from its first to its second position.

13. A construction element according to claim 11, wherein said clamping elements comprise at least one part made of a flexible or elastic material disposed so as to allow said internal structure to be pressed between said at least one part when said multipurpose panel is in its first closed position.

14. A construction element according to claim 11, wherein said clamping elements are arranged on said internal surface of said multipurpose panel so as to be displaced between said clamping position and a retracted position situated outside said internal structure when said multipurpose panel is in its second extended position.

15. A construction element according to claim 1, wherein at least one of said internal structure and said external structure has sealing means which insulates said interior from the exterior when said internal structure is in its second extended position.

16. A construction element according to claim 1, further comprising means for locking said internal structure in its second extended position.

17. A construction element according to claim 1, further comprising drive means associated with said internal structure for displacing said internal structure between its first inserted position and its second extended position; and actuating means operatively connected with said drive means for turning said drive means on and off.

18. A construction element according to claim 1, wherein said multipurpose panel forms a complete side wall of said external structure and is hinged on said external structure along an edge adjacent to said bottom wall; and said multipurpose panel is fixedly connected to two adjacent ones of said corner elements.

19. A construction element according to claim 1, wherein at least one of said plurality of side walls comprises a further multipurpose panel hingedly attached to said external structure and movable between a first closed position and a second open position serving as a floor for said further multipurpose panel; and said internal structure comprises a plurality of internal structures, one of which is displaceable outwardly of said external structure onto said further multipurpose panel when in its second open position.

20. A construction element according to claim 19, wherein said plurality of internal structures fit one inside the other.

21. A construction element according to claim 1, wherein at least one of said front panel and two side panels is at least partially open.

* * * * *